US005176191A

United States Patent [19]

Owens

[11] Patent Number: 5,176,191

[45] Date of Patent: Jan. 5, 1993

[54] HOLDER FOR ROTATING CUTTING KNIVES

[75] Inventor: Mark V. Owens, Kansas City, Mo.

[73] Assignee: Woodmaster Tools, Inc., Kansas City, Mo.

[21] Appl. No.: 733,671

[22] Filed: Jul. 22, 1991

[51] Int. Cl.[5] ..... B27C 13/00

[52] U.S. Cl. ..... 144/230; 144/218; 407/36; 407/41

[58] Field of Search ..... 144/218, 221, 229, 230; 407/36, 41, 49, 108

[56] References Cited

U.S. PATENT DOCUMENTS

| | | | |
|---|---|---|---|
| 1,681,675 | 8/1928 | Miller | 407/36 |
| 1,934,465 | 11/1933 | Hillner | 407/36 |
| 1,951,101 | 3/1934 | Miller | 407/36 |
| 2,917,091 | 12/1959 | Smith et al. | 144/230 |
| 3,866,844 | 2/1975 | Montgomery | 144/230 |
| 4,043,012 | 8/1977 | Rowlson et al. | 144/230 |
| 4,449,556 | 5/1984 | Colton | 144/230 |

*Primary Examiner*—W. Donald Bray
*Attorney, Agent, or Firm*—Hovey, Williams, Timmons & Collins

[57] ABSTRACT

A holder for rotating cutting knives includes a cylindrical holder including a longitudinal groove and a blade having a cutting edge and an opposed edge separated from the cutting edge by a first contact face. A gib assembly is provided for holding the blade in the groove of the holder, and includes a gib movable within the groove between a blade insertion position and a blade securing position. The gib has a second contact face that engages the first contact face of the blade when the gib is moved to the second position, and one of the first and second contact faces is provided with at least one longitudinal groove and the other of the first and second contact faces includes at least one longitudinal ridge which mates with the groove when the gib is in the second position in order to prevent the blade from slipping out of engagement with the gib means.

2 Claims, 1 Drawing Sheet

HOLDER FOR ROTATING CUTTING KNIVES

BACKGROUND OF THE INVENTION

1. Field of the Invention

The present invention relates generally to rotating knife devices and, more particularly, to a rotating knife holder including a specially designed gib and blade which provides additional gripping of the blade in order to prevent the blade from slipping from the holder during use.

2. Discussion of the Prior Art

In cutting and planing devices of the type including a rotating pattern knife or planer blade, it is known to provide a holding system including a cylindrical holder having a longitudinal groove. A blade adapted for use with the holder is provided with a cutting edge, a bottom edge opposed to the cutting edge, and a first contact face extending between the cutting and bottom edges. A gib assembly holds the blade within the groove of the holder, the gib assembly including a gib movable within the groove between a first radial position in which the blade may be inserted into and removed from the groove and a second radial position in which the blade is secured within the groove. The gib includes a second contact face that engages the first contact face of the blade when the gib is moved to the second position.

When the blade is mounted on the holder and is used in carrying out a planing or cutting operation, an outward radial force is exerted on the knife by the rotating movement of the holder. This outward force is sometimes sufficient to cause the blade to overcome the gripping force provided by the gib permitting the knife to slip from the holder, thus possibly causing physical injury to any operator in the vicinity of the device.

OBJECTS AND SUMMARY OF THE INVENTION

It is an object of the present invention to overcome this and other shortcomings in the known holding devices, and to provide a holder which positively secures a blade against slippage in the radial direction of a cylindrical holder.

In accordance with this any other objects of the invention, a holder for rotating cutting knives includes a cylindrical holder having a circumferential surface and a groove provided in the circumferential surface and extending in the longitudinal direction of the cylinder. A blade is provided having a first longitudinal edge, a second longitudinal edge, and a first contact face extending between the first and second edges. Gib means hold the blade within the groove of the holder, and includes a gib movable within the groove between a first position in which the blade may be inserted into and removed from the groove and a second position in which the blade is secured within the groove. The gib includes a second contact face that engages the first contact face of the blade when the gib is moved to the second position, one of the first and second contact faces being provided with at least one longitudinal groove and the other of the first and second contact faces including at least one longitudinal ridge which mates with the at least one groove when the gib is in the second position in order to prevent the blade from slipping out of engagement with the gib means.

In a preferred form of the invention the first and second contact faces are each provided with a plurality of longitudinal grooves and a plurality of longitudinal ridges interposed between the grooves.

By providing a construction in accordance with the present invention numerous advantages are achieved. For example, by providing a mating ridge-and-groove assembly, the blade is positively locked into the groove of the holder so that radial movement of the blade is prevented. Further, because the groove and blade extend in the longitudinal direction of the blade and gib, it is possible to easily insert the blade in the groove by sliding the blade longitudinally into the groove.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 1:
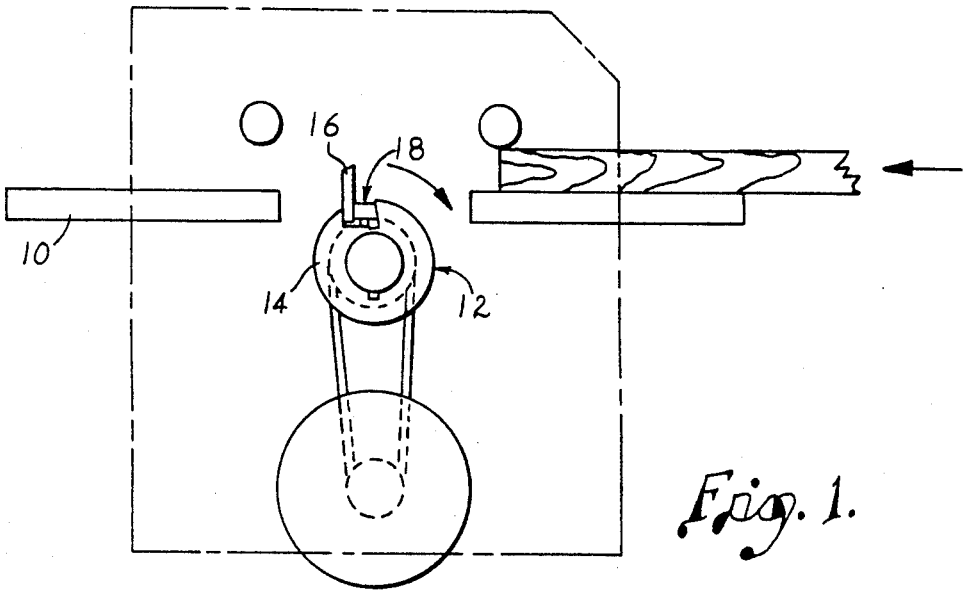
FIG. 1 is a front elevational view of a cutting or planing device adapted for use with a rotating cutting knife which is held in a cylindrical holder, the knife and holder being constructed in accordance with a preferred embodiment of the present invention.

A cutting or planing device is illustrated in FIG. 1, and includes a work support table 10, a holder assembly 12, and drive means for rotating the holder assembly in order to carry out a cutting or forming operation on wood or other workable material.

Figure 2:
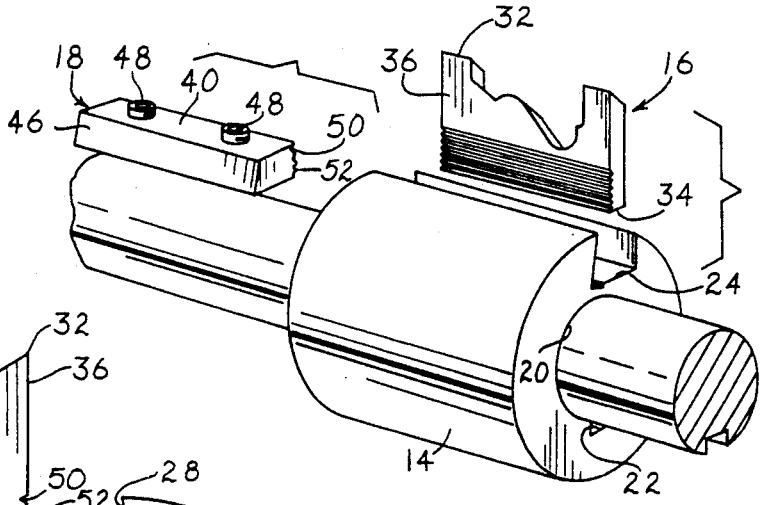
FIG. 2 is an exploded perspective view of the holder assembly.

The holder assembly is shown in FIG. 2 and includes a cylindrical holder 14, a blade 16, and gib means 18 for holding the blade against movement relative to the cylindrical holder. The cylindrical holder 14 includes a bore 20 extending therethrough collinear with the central longitudinal axis of the holder. The bore is circular in cross-section but includes a longitudinal channel 22 extending along the length thereof and adapted to permit the holder 14 to be keyed to a drive shaft extending through the bore. The drive shaft is connected to the drive means in order to permit the drive means to rotate the holder about its longitudinal axis.

Figure 3:
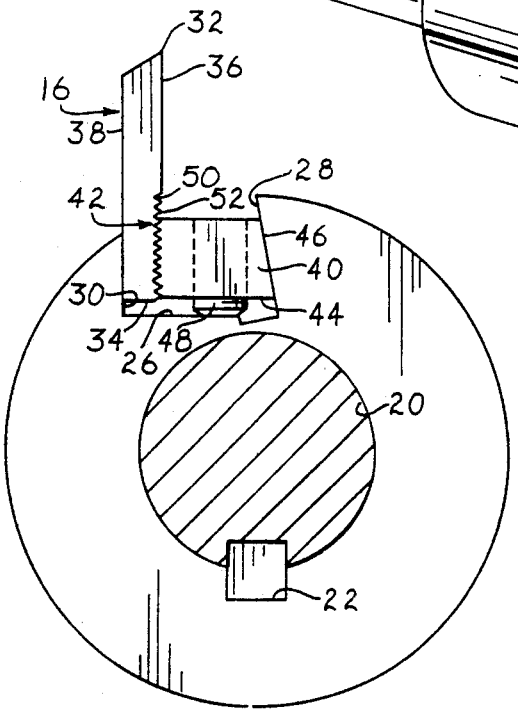
FIG. 3 is a front sectional view of the holder assembly.

The holder 14 is also provided with a longitudinal groove 24 in the outer circumferential surface thereof which extends the length of the holder. As shown in FIG. 3, the groove 24 is defined by a bottom surface 26 and first and second side surfaces 28, 30, wherein the first side surface is angled inward toward the groove relative to a radial plane extending outward from the longitudinal axis of the holder. The second side surface 30 is perpendicular to the bottom surface. Thus, the width of the groove narrows from the bottom surface 26 toward the outer circumferential surface of the holder.

The blade 16 includes a first longitudinal edge 32, a second longitudinal edge 34, and a first contact face 36 extending between the first and second edges. The first longitudinal edge 32 is shaped and sharpened to present a cutting edge that will cut work material to a desired shape when the work material is passed over the rotating holder assembly 12. The second longitudinal edge 34 is blunt, and preferably includes a flattened edge surface adapted to rest on or near the bottom surface 26 of the groove of the holder when the blade is properly positioned therein. The first contact face 36 is adapted to face inward of the groove when the blade is properly positioned in the holder, and a second surface 38 opposes the first contact face and is adapted to rest against the second side surface 30 of the groove when the blade 16 is secured in the holder 14.

The gib means 18 includes a gib 40 positionable within the groove 24 and movable radially relative to the holder between a first, radially inward position in which the blade 16 may be inserted into and removed from the groove and a second, radially outward position in which the blade is secured within the groove. The gib 40 is provided with a second contact face 42 that engages the first contact face 36 of the blade 16 when the gib is moved to the second position. A bottom surface 44 of the gib is formed perpendicular to the plane of the second contact surface 42, and an angled surface 46 is provided opposite the second contact surface 42. The angled surface 46 is slanted relative to the bottom surface 44 at an angle corresponding to the angle of the first side surface 28 of the groove 24.

At least one threaded member 48 extends in a radial direction through a threaded opening provided in the gib 40, the threaded member engaging the bottom surface 26 of the groove 24 when threaded into the gib and moving the gib in a radially outward direction so that the gib moves toward the second position and presses the blade 16 against the holder 14.

As shown in FIG. 3, the first contact face 36 of the blade 16 includes at least one longitudinal groove 50 disposed between the first and second edges at a position adapted to abut the second contact face 42 of the gib 40. Preferably, a plurality of such grooves are provided which are V-shaped and spaced from one another in order to define ridges 52 therebetween.

The second contact face 42 of the gib also includes a series of ridges 52 and grooves 50 which are adapted to mate with the grooves 50 and ridges 52 of the first contact face 36. Although it is only necessary to provide a single groove-and-ridge combination between the first and second contact faces 36, 42 in order to provide positive securement of the blade 16 in the holder 14, it is preferred that a plurality of such combinations be provided in order to simplify the mounting procedure of a knife in the holder.

By providing these groove-and-ridge combinations in the first and second contact faces 36, 42, numerous advantages are achieved. For example, during installation of a blade in the holder, the combinations guide the blade 16 into the groove 24 when the blade is slid longitudinally into the groove between the gib 40 and the second side surface 30 of the groove. Further, once the blade is loosely supported in the groove 24 and the gib 40 is moved toward the second position, the combinations serve to positively lock the blade against radial movement relative to the holder. Thus, even when relatively large radial forces are exerted on the blade due to the rotation of the assembly, the blade is prevented from slipping from the groove.

Although the invention has been described with reference to the preferred embodiment illustrated in the drawing, it is noted that substitutions may be made and equivalents employed herein without departing from the scope of the invention as recited in the claims.

What is claimed is:

1. A holder for rotating cutting knives comprising:

a cylindrical holder including a circumferential surface and a groove provided in the circumferential surface and extending in the longitudinal direction of the cylinder, the groove defining a pair of relatively smooth side surfaces;

a blade having a first contact surface defining a cutting edge, and an opposed, relatively smooth surface adapted to rest against one of the side surfaces of the groove; and a gib means for holding the blade within the groove of the holder, the gib means including a gib movable within the groove between a first position in which the blade may be inserted into and removed from the groove and a second position in which the blade is secured within the groove, the gib including a second contact face that engages the first contact face of the blade when the gib is moved to the second position, the first and second contact faces each being provided with a relatively rough area of contact defined by a plurality of side-by-side longitudinal grooves spaced from one another by longitudinal ridges sized to mate with the longitudinal grooves of the opposing contact face, wherein a substantial area of the first contact face of the blade outside the relatively rough area of contact is relatively smooth.

2. The holder as recited in claim 1 wherein the entire second contact face is covered by the plurality of groove and ridges.

* * * * *